US005967297A

United States Patent [19]

Kaufman et al.

[11] Patent Number: 5,967,297

[45] Date of Patent: Oct. 19, 1999

[54] WIPING ELASTOMERIC SWITCH

[75] Inventors: Dennis Kaufman, Farmington; James Larsen, Farmington Hills, both of Mich.; Christopher Edward Young, Macomb, Ill.; Jim Brian Hull, Keokuk, Iowa

[73] Assignee: Methode Electronics, Inc., Chicago, Ill.

[21] Appl. No.: 09/118,455

[22] Filed: Jul. 17, 1998

[51] Int. Cl.[6] ..... H01H 1/18

[52] U.S. Cl. ..... 200/241; 200/242; 200/512

[58] Field of Search ..... 200/241, 242, 200/243, 248, 253, 237–251, 512–517, 5 A

[56] References Cited

U.S. PATENT DOCUMENTS

| | | | |
|---|---|---|---|
| 4,436,970 | 3/1984 | Swisher | 200/61.56 |
| 4,716,262 | 12/1987 | Morse | 200/5 A |
| 4,839,474 | 6/1989 | Hayes-Pankhurst et al. | 200/5 A |

*Primary Examiner*—Michael L. Gellner
*Assistant Examiner*—Nhung Nguyen
*Attorney, Agent, or Firm*—Karl D. Kovach; David L. Newman

[57] ABSTRACT

An elastomeric switch is provided having self cleanings contacts. The switch includes a substrate and a switch actuator configured for reciprocating motion along an axis generally perpendicular to a surface of the substrate. A first switch contact, including a contact surface generally perpendicular to the actuator axis of motion is, carried by the switch actuator. A second switch contact is cantilevered from the surface of the substrate. Reciprocation of the actuator in a first direction toward the substrate acts to force the first contact against the distal end of the second contact. The two contacts are deflected together as result of further reciprocation of the actuator in the first direction. As the contacts are deflected, the distal end of the second contact is scraped across the contact surface of the first contact, thereby removing contaminants and other debris from the contact surface of the first contact. As the contacts are deflected, the second contact is mechanically biases against the first contact to eliminate contact bounce.

7 Claims, 3 Drawing Sheets

WIPING ELASTOMERIC SWITCH

BACKGROUND OF THE INVENTION

The present invention relates to an Improved Elastomeric Switch particularly adapted for low current switching applications, and for use in harsh environmental conditions.

Elastomeric Switch Assemblies generally comprise an elastomeric keypad mounted over a substrate having at least one pair of stationary contacts mounted thereon. Often such switch assemblies will include more than one switch, and the number of contact pairs formed on the substrate will correspond to the actual number of switches to be included in the assembly. The Elastomeric keypad is generally formed of a resilient material such as silicon rubber, and will include a number of raised tactile button actuators. Clearly, the number of actuators included in the keypad will correspond to the number of fixed contact pairs formed on the substrate. When assembled, the keypad is mounted over the substrate, with each tactile button is located over a fixed contact pair. Each individual switch within the assembly further includes a moving contact mounted between each corresponding tactile button and fixed contact pair. A particular switch is closed when its associated tactile button actuator is pressed downward toward the substrate. The tactile button actuator acts against the moving contact, forcing it against the fixed contact pair to create a conductive path through the switch. When the tactile button actuator is released, the resiliency of the elastomeric keypad lifts the actuator to it normal raised position, the moving contact is pulled away from the stationary contacts, and the circuit is opened.

Such elastomeric switch assemblies are well know and widely used. However in certain applications, including those applications where the switches are switching very low current loads, or are operating in particularly dirty environments, the performance of such switches has been inadequate. A major problem with the present generation of elastomeric switch assemblies has been contact bounce. Contact bounce is a phenomenon that results from the particular geometry of present day elastomeric switches. Generally, the tactile button actuator will act against the moving contact in a linear manner, pressing the moving contact at a right angle onto the fixed contacts. The moving contact engages the fixed contacts and closes the circuit as the tactile button actuator reaches the bottom of its stroke. Because the fixed contacts are formed on the rigid surface of the substrate, the moving contact has a tendency to "bounce" as it engages the two fixed contacts. This bouncing action has a tendency to rapidly open and close the switch circuit prior to the contacts settling into a fully closed position. This can result in false data signals being received at the logic circuitry charged with evaluating the state of the switch. Presently this problem has been resolved by taking multiple readings of the switch state in order to determine the validity of the switch state. This adds both complexity and cost to the evaluating circuitry.

Another problem with currently used elastomeric switch assemblies has been the buildup of contaminants on the switch contacts. This is an especially acute problem in applications where the switch must operate in a dirty environment filled with airborne contaminants. Opening and closing the switch will generally create a small amount of arcing which can fuse contaminants to the surface of the contacts. Over time, as the contaminants build up, the contact resistance of the switch increases. In low current switching applications such increased contact resistance can be extremely detrimental to the quality of the signal being conducted through the switch. In fact, with sufficient contact resistance the signal can be completely blocked. Therefore, an improved elastomeric switch is desired which will eliminate or greatly reduce contact bounce, and will prevent contaminants from building up on the surface of the contacts. Such a switch should allow contact overtravel beyond the point of initial contact engagement, with at least one switch contact being mechanically biased against another. Further, the switch contacts should be configured to provide a self cleaning operation wherein contaminants are removed from the contact surfaces with each operation of the switch in order to maintain a low switching resistance. Such a switch should be especially adapted for switching low current loads and be capable of extended use in environmentally harsh conditions.

SUMMARY OF THE INVENTION

In light of the prior art as described above, one of the main objectives of the present invention is to provide an improved elastomeric switch.

A further object of the present invention is to provide an improved elastomeric switch particularly adapted for use in switching low current loads.

Another objective of the present invention is to provide an improved elastomeric switch particularly adapted for extended use in harsh environmental conditions.

Still another objective of the present invention is to provide an improved elastomeric switch which significantly reduces or eliminates contact bounce as the switch is closed.

Yet another objective of the present invention is to provide an improved elastomeric switch which allows extended overtravel of the switch contacts after the switch is closed.

An additional objective of the present invention is to provide an improved elastomeric switch wherein the switch contacts are self cleaning.

A further objective of the present invention is to provide an improved elastomeric switch wherein the interaction of the various switch contacts acts to clean the contacts as the switch is opened and closed.

A still further objective of the present invention is to provide an improved elastomeric switch wherein the self cleaning action of the switch contacts prevents increased contact resistance from interfering with switched low current signals.

All of these objectives, as well as others that will become apparent upon reading the detailed description of the presently preferred embodiments of the invention, are met by the Wiping Elastomeric Switch herein disclosed.

The present invention relates to an improved elastomeric switch suitable for use in low current switching applications as well as in harsh contaminated environments. The switch comprises a rigid substrate and a resilient tactile switch actuator configured for reciprocating motion along an axis generally perpendicular to the surface of the substrate. A first switch contact is mounted above the substrate and includes a contact surface generally parallel to the surface of the substrate. A second contact is mounted on the surface of the substrate. The second contact includes a cantilevered beam which rises at an angle between 0° and 90° from the surface of the substrate. The switch actuator is supported by a resilient collapsible wall. When external pressure is applied to the actuator the support wall collapses, and the actuator reciprocates in a first direction toward the surface of the substrate. When the external force is removed from the actuator, the resilient support wall springs back to its normal support position, causing the actuator to reciprocate in a second direction away from the surface of the substrate. As the actuator moves toward the substrate, the first contact is forced against the distal end of the second contact, causing the second contact to deflect toward the substrate. As the second contact is forced toward the surface of the substrate, the end of the second contact is scraped across the under surface of the first contact, thereby cleaning the surface of the first contact of any contaminants which may have built up on the contact. Initial engagement of the first and second contacts occurs prior to the actuator reaching the bottom of its stroke. As the actuator continues its downward stroke, the deflection of the second contact mechanically biases the second contact against the first contact, thereby significantly reducing, if not entirely eliminating, contact bounce as the switch is closed.

In a first embodiment of the invention, the substrate includes a raised portion, which may comprise a second substrate mounted on the surface of the first substrate. The first contact is cantilevered from this raised section of the substrate, extending horizontally over the second contact. The second contact extends from the first surface of the substrate at an angle of approximately 45° toward the first contact. Switch leads connect both, the first and second contact to circuitry external to the switch. When the tactile actuator is depressed, the actuator forces the first contact against the second contact, thereby closing the switch. The two contacts engage one another at an intermediate point within the actuator stroke. As the actuator continues its downward motion, the two contacts remain in continuous contact and both the first and second contacts are deflected toward the surface of the substrate. As the two contacts are deflected, the wiping action of the second contact against the first contact acts to clear contaminants from the contact surface of the first contact. Further, the substrate may include a hole located directly beneath the switch contacts such that the switch actuator will not bounce off the surface of the substrate when the actuator reaches the bottom of its stroke.

In a second embodiment, the first contact is carried by the tactile switch actuator, and a pair of fixed contacts are adhered to the surface of the substrate. Each of the fixed contacts includes a cantilevered segment angled away from the surface of the substrate. The switch leads connect the two fixed contacts to circuitry external to the switch. The first contact is carried generally parallel to the surface of the substrate, and is forced toward the surface of the substrate as the switch actuator is pressed down. The lower surface of the first contact engages the distal ends of each of the fixed contacts at a point above the surface of the substrate, thereby completing a circuit across the two fixed contacts. Continued motion of the actuator in its downward stroke deflects the cantilevered segments of the fixed contacts toward the surface of the substrate. The deflection of the two fixed contacts causes a wiping action across the lower surface of the first contact. Again, the wiping action acts to clear contaminants from the contact surface of the first contact.

DETAILED DESCRIPTION OF THE PRESENTLY PREFERRED EMBODIMENTS

Figure 1:
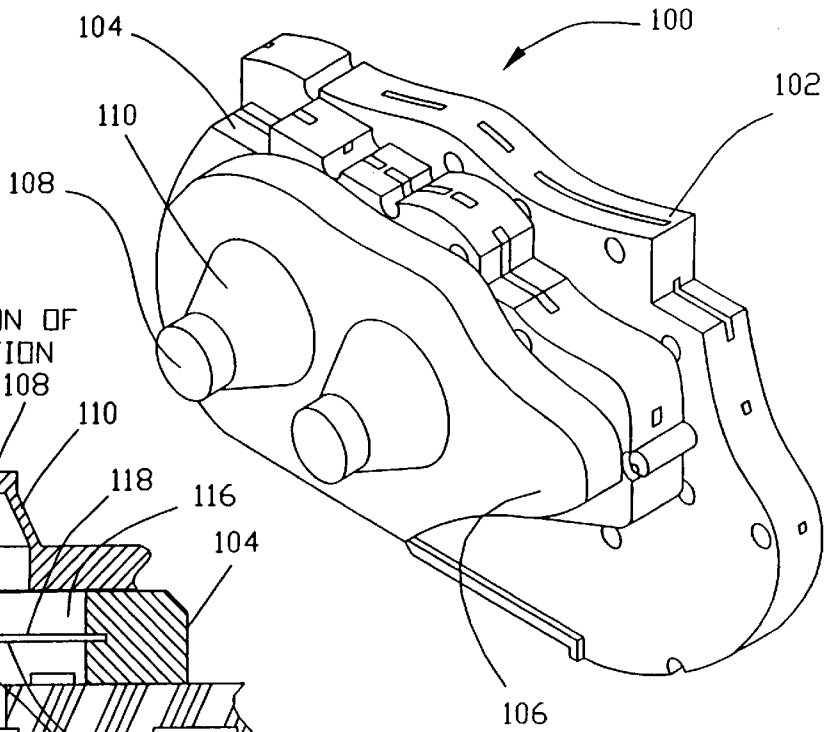
FIG. 1 is an isometric view of an elastomeric switch according to a first embodiment of the invention.

Referring to FIGS. 1, 2*a*, 2*b*, and 2*c*, an elastomeric switch assembly 100 according to a first embodiment of the invention is shown. Elastomeric switch 100 includes a first substrate 102, a second substrate 104 and an elastomeric keypad 106. Substrates 102, 104 may be formed of any insulating material, including, but not limited to FR-4 or CERMET printed circuit boards. The switch assembly shown includes two switch apparatus, however, it should be clear to those skilled in the art that a similar switch assembly incorporating the novel aspects of the present invention may be constructed having any number of switch apparatus. The components of each switch within switch assembly 100 are identical, therefore a description of only one will be given here.

Elastomeric keypad 106 includes a raised tactile switch actuator 108 for each switch within assembly 100. Actuator 108 includes a depending piston 112 for engaging the switch contacts as described below. Actuator 108 is supported by a collapsible support wall 110, which surrounds actuator 108. Support wall 110 is configured to allow actuator 108 to reciprocate vertically relative to substrates 102, 104. When a sufficient downward external force is applied to actuator 108, support wall 110 rapidly collapses allowing actuator 108 and piston 112 to move from a first raised position to a second depressed position. As the switch is actuated, collapsing support wall 110 provides a reliable tactile indication that the switch actuator has moved from the first raised position to the second depressed position. The first position indicates that the switch contacts are open, and the second position indicates that the switch contacts are closed.

Each of the first and second substrates 102, 104 include holes 114, 116 respectively. At least a portion of each hole 114, 116 is approximately aligned with the axis of motion of piston 112 as it reciprocates between the first and second positions. A first contact 118 is partially embedded in substrate 104 and cantilevered horizontally across hole 116, crossing beneath piston 112. A second cantilevered contact 120 is partially embedded in substrate 102 and extends across hole 114. However, rather than extending horizontally, contact 120 is angled upward toward contact 118. Contact leads (not shown) formed on or within substrates 102, 104 are provided to connect contacts 118, 120 to circuitry external to switch assembly 100.

Figure 2A:
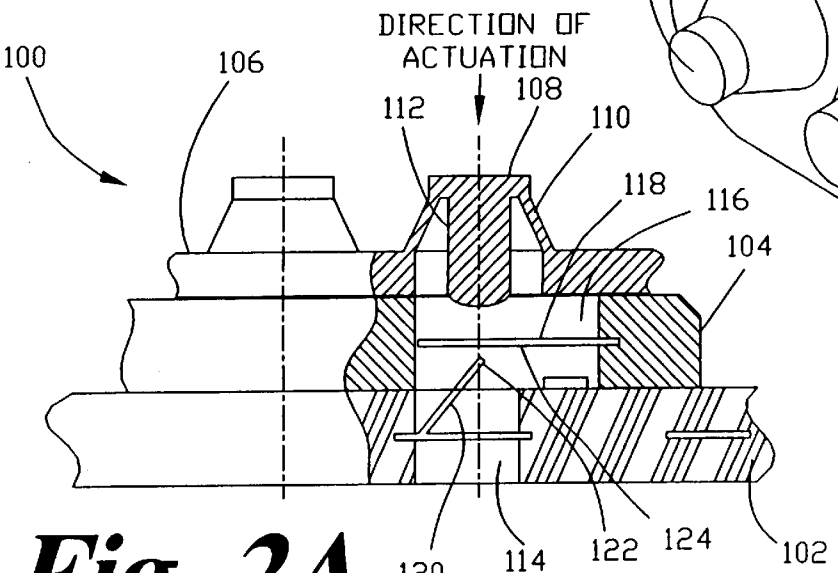
FIG. 2*a* is a cutaway plan view of the elastomeric switch of FIG. 1; showing the switch actuator in the raised or open position.

The Operation of switch assembly 100 will now be described in relation to FIGS. 2*a*, 2*b* and 2*c*. FIG. 2*a* shows switch actuator 108 in the first, raised position where no external force has been applied to close the switch. In this position contact 118 remains approximately horizontal beneath piston 112. In this position, a definite air gap exists between first contact 118 and second contact 120. Therefore, when switch actuator 108 is in the raised position, the switch is open and no electrical current will be conducted across contacts 118, 120.

Figure 2B:
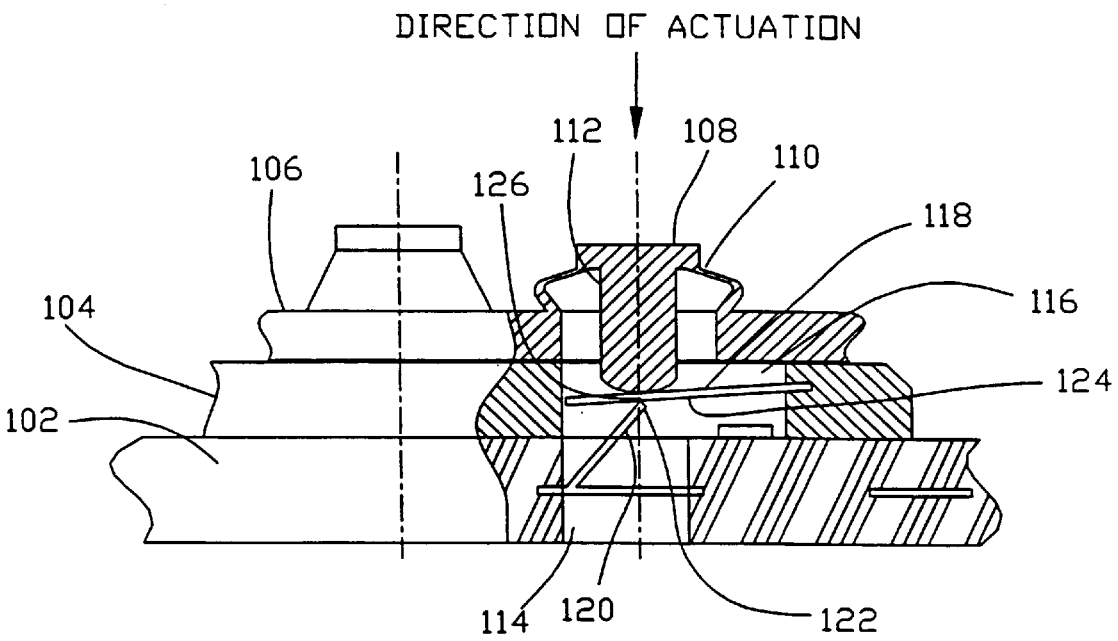
FIG. 2*b* shows the same cutaway plan view of FIG. 2*a*, with the switch actuator in an intermediate position between the raised and depressed positions.

FIG. 2*b*, shows switch actuator 108 in an intermediate position between the first raised position and the second depressed position. This is merely a transitory state which will only occur as switch actuator 108 moves between the first and second positions. In this transitory position, the tactile nature of collapsing support wall 110 will force actuator 108 either to the first position or the second position, depending on the downward force applied to actuator 108. In this intermediate state, however, it can be seen that piston 112 deflects cantilevered first contact 118 toward second cantilevered contact 120 such that the distal end 122 of the second contact 120 physically engages the underside, or contact surface 124, of first contact 118. Thus, the switch is actually closed and current will flow through the switch, when the switch contacts are in this intermediate position prior to actuator 108 reaching the fully depressed position.

Figure 2C:
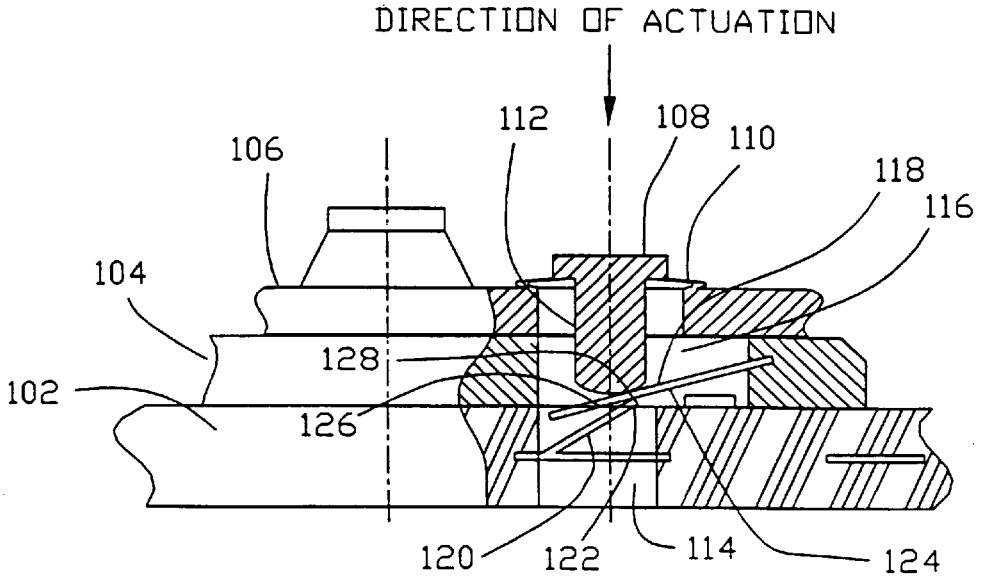
FIG. 2*c* shows the same cutaway plan view of FIGS. 2*a* and 2*b*, with the switch actuator in the depressed, or closed position.

Switch assembly 100 provides contact overtravel and prevents contact bounce in that, as support wall 110 collapses, actuator 108 and piston 112 travel through the position shown in FIG. 2*b* on the way to the fully depressed second position shown in FIG. 2*c*. As piston 112 continues moving downward, first contact 118 is deflected further against second contact 120. The angled orientation of second contact 120 mechanically biases the second contact against the contact surface 124 of first contact 118. Thus, there is little or no bounce of second contact 120 away from first contact 118 as actuator 108 transitions through the position shown in FIG. 2*b*. Contacts 118, 120 "overtravel" beyond this point of initial contact until they reach the depressed second position shown in FIG. 2*c*. Here, it should be noted that piston 112 and contacts 118, 120 do not actually abut either the first or second substrates when actuator 108 reaches the second depressed position. This provides further insurance that the contacts will not bounce as actuator 108 reaches the bottom of its stroke.

An additional feature of the contact arrangement just described is the wiping, or scrubbing action of the distal end 122 of second contact 120 against the contact surface 124 of first contact 118. This is best understood by comparing the contact positions of FIGS. 2*b* and 2*c*. In FIG. 2*b*, first contact 118 has been deflected by piston 112 only the point where distal end 122 of second contact 120 just touches contact surface 124 of first contact 118. At this point, second contact 120 has not been deflected at all by first contact 118. This point of initial engagement is shown designated as 126. In contrast, when switch actuator 108 has reached the fully depressed second position as shown in FIG. 2*c*, piston 112 has significantly deflected both contacts 118 and 120. In this position, distal end 122 of second contact 120 has moved relative to first contact 118. In this position, the point of contact between distal end 122 of second contact 120 and contact surface 124 of first contact 118 is designated 128. Comparing FIGS. 2*b* and 2*c*, it is clear that distal end 122 of second contact 126 is scraped across contact surface 124 as contacts 118, 120 are deflected toward their final positions shown in FIG. 2*c*. This scraping or wiping action has the effect of clearing dirt and other contaminants from contact surface 124. Thus, with every operation of the switch contact surface 124 is cleaned by distal end 122 of second contact 120. This helps to keep the contact resistance low to prevent signal losses when switching low current loads.

Figure 3A:
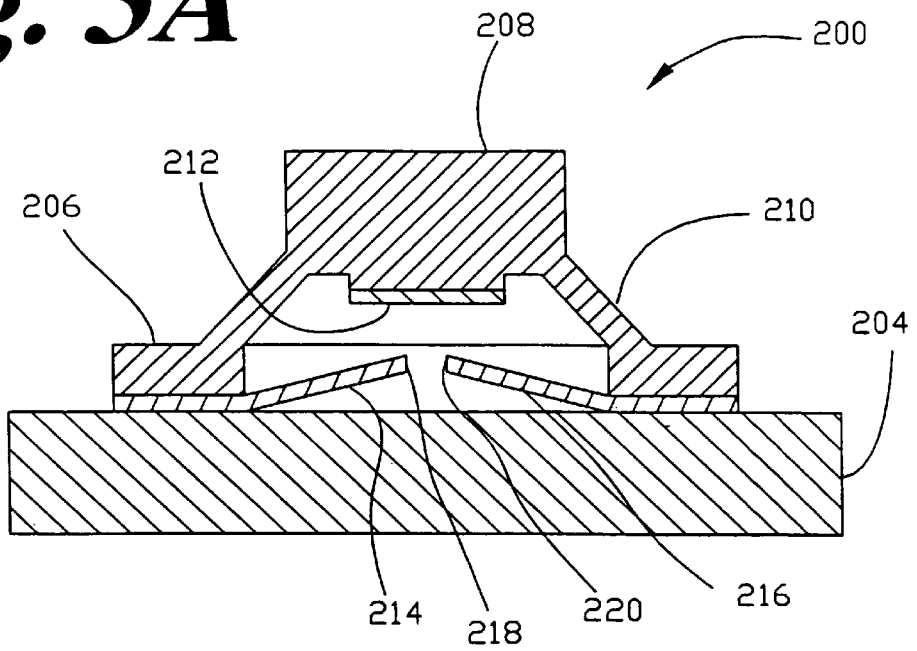
FIG. 3*a* is a section view of an elastomeric switch according to a second embodiment of the invention, showing the switch in the raised, or open position.
Figure 3B:
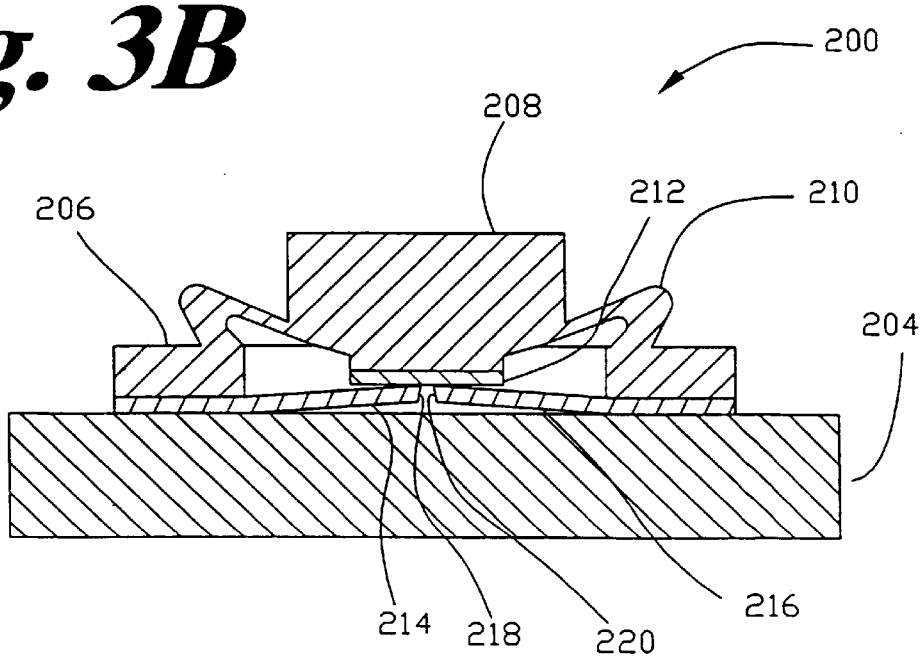
FIG. 3*b* shows the same section view of FIG. 3*a* showing the switch actuator in the depressed, or closed position.

A second embodiment of an elastomeric switch assembly 200 is shown in cross section in FIGS. 3*a* and 3*b*. Switch assembly 200 comprises a substrate 204 and an elastomeric keypad 206. As with the previous embodiment, any number of switch apparatus may be included in switch assembly 200, however, only one such switch will be described here.

Elastomeric keypad 206 includes one raised tactile switch actuator 208 for each individual switch contained in assembly 200. Raised tactile switch actuator 208 is supported by a collapsible support wall 210 which surrounds actuator 208. Support wall 210 is configured to allow actuator 208 to reciprocate vertically relative to substrate 204. When sufficient downward external force is applied to actuator 208, support wall 210 rapidly collapses, allowing actuator 208 and a moving contact 212 attached thereto, to move from a first, raised position depicted in FIG. 3*a*, to a second depressed position depicted in FIG. 3*b*. The collapsing support wall 210 provides a reliable tactile indication that switch 208 has moved from the first position to the second position, wherein the first position represents the switch contacts being open, and the second position represents the switch contacts being closed. When the downward force is removed, the resiliency of the collapsed support wall 210 snaps back to the first raised position, opening the switch.

In addition to moving contact 212 which is carried by actuator 208, a pair of fixed contacts 214, 216 are cantilevered from the surface of substrate 204. Contacts 214–216 extend from the substrate at an angle between 0° and 90°, preferably approximately 30°–45°. The cantilevered contacts 214, 216 are configured such that as actuator 208 reciprocates toward substrate 204, moving contact 212 engages the distal ends 218, 220 of both cantilevered contacts 214, 216, thereby completing an electrical circuit therebetween. As with the previous embodiment, the point of contact between the various contacts 212, 214, 216, occurs at an intermediate point in the downward stroke of actuator 208. Thus, the switch is actually closed prior to actuator 208 reaching the fully depressed position.

Switch assembly 200 provides contact overtravel and prevents contact bounce in that, as support wall 210 collapses, actuator 208 and moving contact 212 travel beyond the point of initial engagement with contacts 214, 216 enroute to their final position in the depressed position shown in FIG. 3*b*. After the point of initial contact, cantilevered contacts 214, 216 are deflected toward the surface of substrate 204. Elastic forces within contacts 214, 216 bias the contacts against moving contact 212 as the contacts continue their downward motion toward substrate 204. Thus, there is little or no bounce of contacts 214, 216 away from moving contact 212 during the downward stroke of actuator 208.

Furthermore, contact scrubbing occurs in a manner similar to that of the first embodiment. As actuator 208 moves toward substrate 204, and moving contact 212 deflects cantilevered contacts 214, 216, and the distal ends 218, 220 of contacts 214, 216 are scraped across the contact surface of moving contact 212. Again, the scraping, or wiping action, has the effect of clearing debris and other contaminants from the surface of moving contact 212. Thus, with every operation of the switch, the contact surface of moving contact 212 is cleaned by distal ends 218, 220 of contacts 214, 216. This helps to maintain low contact resistance across the switch, and prevents signal losses when switching low current loads.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. A switch having self cleaning contacts comprising:

a first substrate;

a switch actuator configured for reciprocating motion along an axis generally perpendicular to a surface of the first substrate;

a second substrate substantially located between the first substrate and the switch actuator when the switch actuator is in a raised position;

a first switch contact including a contact surface generally perpendicular to the switch actuator axis of motion, the first switch contact cantilevered from the second substrate;

a second switch contact cantilevered from the surface of the first substrate below the first switch contact;

an elastomeric keypad including a raised portion resiliently mounted above the second substrate;

reciprocation of the switch actuator in a first direction toward the first substrate acting to force the first switch contact against a distal end of the second switch contact; and further reciprocation of the switch actuator in the first direction deflecting the second switch contact, such that the distal end of the second switch contact is scraped across the contact surface of the first switch contact.

2. The switch of claim I wherein the first and second switch contacts are configured to allow overtravel of the first and second switch contacts as the switch actuator reciprocates in the first direction beyond a point of initial engagement between the first and second switch contacts.

3. An electrical switch comprising:

a substrate;

first and second contacts affixed to a surface of the substrate, each including a cantilevered segment angled away from the surface of the substrate;

a reciprocating actuator supported opposite the cantilevered segments by an elastomeric support;

a third contact carried by the reciprocating actuator positioned to engage a distal end of each of the first and second contacts as the actuator reciprocates in a first direction toward the surface of the substrate; and the cantilevered segments of the first and second contacts deflecting with further reciprocation of the actuator towards the substrate, causing the distal ends thereof to scrub a surface of the third contact.

4. The electrical switch of claim 3 wherein the actuator and elastomeric support comprise an integrally formed tactile key pad.

5. The electrical switch of claim 3 wherein the first and second contacts are configured to allow overtravel of the first, second, and third contacts in the first direction beyond a point of initial engagement between the first contact and the third contact and between the second contact and the third contact.

6. An elastomeric switch having self cleaning contacts comprising:

a first substrate having a first cantilevered contact extending therefrom;

a second substrate having a second cantilevered contact extending therefrom, the second contact configured to engage the first contact;

an elastomeric cover including a depressible actuator positioned over the first and second contacts; and whereby depressing the actuator causes the second contact to engage the first contact, the first contact scraping across a surface of the second contact as the actuator is depressed.

7. The switch of claim 6 wherein the first and second contacts are arranged to allow overtravel of the contacts beyond a point of initial engagement between the said contacts.

* * * * *